United States Patent [19]

Pannocchia

[11] Patent Number: 4,495,273

[45] Date of Patent: Jan. 22, 1985

[54] COLOR PHOTOGRAPHIC ELEMENTS WITH IMPROVED MECHANICAL PROPERTIES

[75] Inventor: Mario Pannocchia, Ferrania, Italy

[73] Assignee: Minnesota Mining and Manufacturing Company, St. Paul, Minn.

[21] Appl. No.: 298,942

[22] Filed: Sep. 3, 1981

[30] Foreign Application Priority Data

Sep. 17, 1980 [IT] Italy ..... 49692 A/80

[51] Int. Cl.[3] ..... G03C 1/84

[52] U.S. Cl. ..... 430/510; 430/505; 430/514; 430/517; 430/531; 430/534; 430/539; 430/954

[58] Field of Search ..... 430/510, 514, 517, 531, 430/534, 930, 954, 505, 539

[56] References Cited

U.S. PATENT DOCUMENTS

| | | | |
|---|---|---|---|
| 3,460,945 | 8/1969 | Kolesinski et al. | 430/534 |
| 3,515,567 | 6/1970 | Tani et al. | 117/11 |
| 3,615,555 | 10/1971 | Grabhofer et al. | 430/930 |
| 3,632,342 | 1/1972 | Salesin et al. | 430/531 |
| 4,116,696 | 9/1978 | Tatsuta et al. | 430/531 |
| 4,301,240 | 11/1981 | Bruck et al. | 430/534 |

*Primary Examiner*—J. Travis Brown

*Attorney, Agent, or Firm*—Donald M. Sell; James A. Smith; Mark A. Litman

[57] ABSTRACT

Silver halide photographic elements comprising a support on which there is spread a plurality of photosensitive layers of gelatin incorporating silver halides and containing coupling agents, and further being associatd with auxiliary gelatin layers tend to suffer from brittleness. An improved element comprises, spread over said support and under said plurality of photosensitive layers, a layer of gelatin in which there is dispersed a fragility reducing quantity of droplets of a water-immiscible high boiling organic solvent, and an adhesion promoting quantity of a vinyl addition polymer latex.

14 Claims, No Drawings

COLOR PHOTOGRAPHIC ELEMENTS WITH IMPROVED MECHANICAL PROPERTIES

TECHNICAL FIELD

This invention relates to color photography, and more precisely to color photographic elements with improved mechanical characteristics.

Color photographic elements comprise a plurality of hydrophilic layers (i.e., permeable to the aqueous photographic treatment solutions) of an emulsion of silver halides dispersed in gelatin, and associated with auxiliary hydrophilic gelatin layers (for example, filter layers, external protective layers, intermediate layers, antihalo layers), said plurality of layers being spread over a hydrophobic support.

Silver halide emulsions are naturally sensitive (or sensitized) towards blue, and are associated with non-diffusing coupling agents forming yellow dyes (by paraphenylenediamine color development after exposure), or are sensitized towards green and associates with non-diffusing coupling agents forming magenta dyes (blue-red), or are sensitized towards red and associated with non-diffusing coupling agents forming cyan dyes (blue-green).

BACKGROUND ART

Non-diffusing coupling agents can be introduced into the photographic layers containing them either in aqueous alkaline solution (in this case at least one acid solubilizing group of the $SO_3H$ or COOH type must be present in the coupling agent molecule), or dissolved in a high boiling solvent dispersed in the spreading composition of the layer. Briefly, this second method, which is preferred for the purposes of the present invention, is known as the "dispersion method", and substantially consists firstly of dissolving the coupling agent in a water-immiscible organic solvent, and then dispersing the solution thus obtained as extremely fine droplets in the gelatin (a description of the dispersion method is given in U.S. Pat. Nos. 2,322,207, 2,801,170, 2,801,171 and 2,991,177).

The mechanical properties of the photographic material depend on those of their constituent layers. Even in the presence of a good support, properties can be comprised by the poor characteristics of the other layers. In this respect, the mechanical properties of the gelatin layers of the aforesaid photographic elements, for example, their elasticity, fragility and flatness, depend largely on climatic conditions. In, for example, low humidity and temperature conditions, if the gelatin layers are subjected to bending, they break and this breakage is transmitted from one layer to another until it reaches the support, to also damage this layer.

DISCLOSURE OF THE INVENTION

Numerous attempts have been made to increase the flexibility of the gelatin layers by adding both hydrophilic and hydrophobic plasticizers. Normally, hydrophilic plasticizers operate by virtue of the fact that being hydroscopic, they retain the moisture in the gelatin layers. However, under very low humidity conditions, they make the layer even more fragile. Hydrophobic plasticizers generally produce improvements in the mechanical properties of the gelatin layers only if added in such quantities as to worsen the photographic properties of the element. From experiments carried out by the applicant, it has been found that poor mechanical properties of the gelatin layers (both the emulsion layers and the auxiliary layers) can be prevented from being transmitted to the support by reducing the adhesion between them and the support layer itself. It has been found experimentally that adhesion can be reduced by adjusting the film drying conditions, and by using special surface active agents. However, if the photographic element is made non-breaking by reducing the adhesion, considerable drawbacks arise in the various stages of the photographic process, in particular, in the perforation, cutting, practical handling, development and printing.

It has now been found that a photographic element comprising a plurality of emulsion layers compring silver halides of different sensitivity to light dispersed in gelatin, and including color-forming coupling agents, and associated with auxiliary gelatin layers spread over a hydrophobic support, presents improved mechanical characteristics (in particular, a lower fragility of the photographic element with good adhesion between the gelatin layers and the support) if in the presence of an auxiliary gelatin layer which is spread over the support below said plurality of emulsion layers associated with auxiliary layers, and which contains, dispersed therein, droplets of a water-immiscible high boiling organic solvent containing a vinyl addition polymer latex. In particular, it has been found that in the presence of such a layer, said elements do not suffer from fragility even at low temperature and relative humidity (in the sense that any breakage of the emulsion layers is not transmitted to the support), or from lack of adhesion between the layers and the support.

It has been found, in particular, that said droplets are essential in said auxiliary gelatin layer in order to prevent the poor qualities (in particular, the fragility) of the gelatin layers becoming transmitted to the support, and said latex allows recovery of the adhesion lost in the presence of such an auxiliary layer, as happens in a photographic material with good mechanical characteristics even with good adhesion between the gelatin layers and the support.

Both the quantity of said polymer and the quantity of said droplets have proved critical for the purposes of the present invention in the sense that lower quantities than those necessary would not give the required results. Higher quantities than those strictly necessary could negatively influence the spreadability of the layer, its opacity, or other purely photographic characteristics. It will in any case be easy for the expert of the art to choose the most suitable quantities in accordance with the experimental conditions under which he works. In experiments carried out by the applicant, it has been found that preferred latex quantities are at least 10% and preferred droplet quantities are at least 15% by weight with respect to the gelatin of said auxiliary layer.

Consequently, the present invention relates to color photographic elements comprising a plurality of emulsion layers of silver halides in gelatin which are sensitive to different regions of the visible spectrum and contain color-forming coupling agents, these being associated with auxiliary gelatin layers and spread over a support, characterized by an auxiliary layer spread over said support below said plurality of emulsion layers and containing, dispersed therein, droplets of a water-immiscible high boiling organic solvent in such a quantity as to prevent film fragility, and a vinyl addition polymer latex in such a quantity as to improve adhesion between the layers and the support.

The present invention preferably relates to photographic elements as heretofore defined, in which said organic solvent has a boiling point exceeding 200° C. and a water solubility at 25° C. of less than 0.5 g/l, said organic solvent being more preferably chosen from the class consisting of dibutylphthalate, tricresylphosphate, triphenylphosphate, di-2-ethylhexylphthalate, di-n-octylphthalate, tris-2-ethylhexylphosphate, acetyltributylcitrate, di-n-hexyladipate, di-2-ethylexyladipate, dimethylsebacate, triethyleneglycol-di-2-ethylhexoate, ethylphthalylethylglycolate, quinitol-bis-(2-ethylhexoate) and 1,4-cyclohexyldimethylene-bis-(2-ethylhexoate).

The present invention relates still preferably to the aforesaid photographic elements in which said vinyl addition polymer has a glass transition temperature of less than 25° C.; more preferably, said vinyl addition polymer being chosen from the class consisting of polyethylacrylate, polybutylacrylate, polyethoxyethylacrylate, polyhexylacrylate, polyethylhexylacrylate, polybutylmethacrylate and polyethoxyethylmethacrylate.

The present invention relates in particular to the aforesaid photographic elements, in which the proportion of said organic solvent present is at least 50% by weight with respect to the gelatin of the auxiliary layer, and/or the proportion of said vinyl addition polymer present is at least 10% by weight with respect to the gelatin of the auxiliary layer.

The present invention also relates in particular to the aforesaid photographic elements in which the dispersed droplets of said organic solvent have an average size of between 0.1 and 1$\mu$, and preferably between 0.15 and 0.3$\mu$, and/or the particles of said vinyl addition polymer latex have a size of between 0.03 and 0.4$\mu$, and preferably between 0.05 and 0.1$\mu$.

According to a further preferred aspect, the present invention relates to the aforesaid photographic elements, in which said non-sensitive auxiliary gelatin layer is an anti-halo layer, preferably an anti-halo layer incorporating colloidal silver. Still preferably, the present invention relates to the aforesaid photographic elements, in which said auxiliary layer has a thickness of between about 2 and about 10$\mu$, and more preferably between about 2 and about 6$\mu$.

According to a further aspect, the present invention relates to a method for reducing the fragility of a photographic element as heretofore defined, and for improving adhesion between the gelatin layers of the support, said method consisting of adding an aqueous dispersion of droplets of a water-insoluble high boiling organic solvent, in such a quantity as to prevent fragility, and a vinyl addition polymer latex in such a quantity as to improve adhesion, to the gelatin spreading solution for an auxiliary layer, and then spreading the resultant composition over the support, followed by the compositions of said plurality of layers in sequence.

The organic solvents (indicated hereinafter as oils) which can be used for the purposes of the present invention are characterized as non-polymer organic compounds having a boiling point exceeding 200° C. and a water solubility of less than 0.5 g/l at 25° C., and are ordinarily used in dispersing coupling agents and photographic additives as described, for example, in U.S. Pat. Nos. 2,322,027, 2,801,170, 2,801,171, 2,272,191, 2,304,940 and 3,748,141.

Even though a wide variety of oils can be used, those which are most preferable for the purposes of the present invention (because of the fact that they show no negative effects on the sensitive material, are easily obtainable and easy to handle because of their excellent chemical stability) have been found to be oils chosen from the class comprising dibutylphthalate, tricresylphosphate, triphenylphosphate, di-(2-ethylhexyl)-phthalate, di-n-octylphthalate, tris-(2-ethylhexyl)-phthalate, acetyltributylcitrate, di-(n-hexyl)-adipate, di-(2-ethylhexyl)-adipate, dimethylsebacate, triethyleneglycol-di-2-ethylhexoate, ethylphthalylethylglycolate, quinitol-di-(2-ethylhexoate) and 1,4-cyclohexyldimethylene-di-(2-ethylhexoate). The oils are present in the auxilary layer for the purposes of the present invention in the form of fine droplets (of a size between 0.1 and 1$\mu$, more preferably, between 0.15 and 0.30$\mu$), which are produced by known methods, the most commonly used consisting of firstly dissolving the oils, either alone or in mixture (two or more), in a low boiling solvent (such as methylacetate, ethylacetate, propylacetate, butylacetate, butylpropionate, cyclohexanol, diethyleneglycolmonoacetate, nitromethane, carbon tetrachloride, chloroform, cyclohexane, tetrahydrofuran, methyl alcohol, ethyl alcohol, propyl alcohol, acetonitrile, dimethylformamide, dioxane, acetone, methylethylketone, methylisobutylketone and the like, used either individually or in combination), then mixing the solution with an aqueous solution of gelatin or another hydrophilic colloidal substance containing one or more anionic dispersing agents of the type normally used in photography (such as dioctylsodiumsulphosuccinate, sodiumlaurylsulphate, sodiumalkylnaphthalenesulphate and others described in Schwarty et al., Surface Active Agents and Detergents, Vol. I and II, Interscience Publishers, and in U.S. Pat. Nos. 2,992,108, 3,068,101, 3,201,252 and 3,165,409, in French Pat. Nos. 1,556,240 and 1,497,930, and U.K. Pat. Nos. 580,504 and 985,483), in particular cases where necessary, cationic or non-ionic dispersing agents (of the type described, for example, in U.K. Pat. No. 1,274,523 and in U.S. Pat. Nos. 3,762,025 and 3,860,425), and finally dispersing the composition obtained in this manner using a suitable means such as a colloidal mill, a high speed rotating mixer or an ultrasonic disperser.

Normally, for the purposes of the present invention, the oil droplets can include photographic additives of a hydrophilic nature, and more preferably of an oleophilic nature. Typically such additives include UV absorbers, anti-staining agents, compounds which release developing inhibitors, optical bleaches, anti-oxidants, etc.

The vinyl addition polymers which can be used for the present invention are obtained by polymerizing suitable monomers in an emulsion. The preferred monomers are ethylene-unsaturated monomers of the acrylic or methacrylic acid ester type, such as ethylacrylate, methylmethacrylate, methylacrylate, butylmethacrylate etc.; alkyl-substituted acrylamides such as N, N-dibutylacrylamide, N-octylacrylamide, etc.; vinyl esters such as vinylacetate, vinylbutyrate, etc.; dienes such as butadiene, isoprene, dimethylbutadiene, chloroprene, fluoroprene, etc.; aromatic compounds such as styrene, vinyltoluene, etc.; vinylhalides such as vinylchloride and vinylidenechloride, acrylonitrile, methacrylonitrile, vinylpyridine, vinylquinoline and other commonly known similar monomers.

These polymers are dispersed in the auxiliary layer of the present invention in the form of very small particles of a size between 0.03 and 0.4μ, and more preferably between 0.04 and 0.1μ. Said aqueous dispersions of polymers or latexes are usually prepared by dispersing one or more of the aforesaid monomers in water in the presence of a dispersing or surface active agent of the type already described heretofore for dispersing the oil, and carrying out polymerization by the use of a water-soluble initiator which generally a per-compound (ammonium or potassium persulphate, hydrogen peroxide, sodium perborate, etc.), or a redox system such as persulphate-bisulphite, or a compound of the α,α'-azo-bis-isobutyroamidine hydrochloride type and 4,4'-azo-bis-4-cyanopentanoic acid (U.S. Pat. Nos. 2,739,137 and 2,599,300 and U.K. Pat. No. 759,409), or a water-insoluble initiator (such as azo-bis-isobutyronitrile, benzoyl-peroxide, or cumenehydroperoxide. In preparing the latex, it is often advantageous to use, together with the aforesaid monomers, smaller quantities of water-soluble monomers such as acrylic or methacrylic acid, acrylamide, N-methylacrylamide, methacrylamide, vinylpyrrolidone, vinyloxazolidone, potassium vinylbenzenesulphonate, sodium 3-acryloyloxypropane-1-sulphonate, sodium 3-methacryloyloxypropane-1-methylsulphonate or sodium 2-acrylamido-2-methylpropanesulphonate, as described, for example, in BE Pat. No. 869,816.

Preferably, for the purposes of the present invention, as heretofore stated, the vinyl addition polymers should have a glass transition temperature of less than 25° C. (the term "glass transition" referring to the characteristic change in the polymer properties from referring to the characteristic change in the polymer properties from those of a relatively hard, fragile, vitreous material to those of a softer, more flexible substance similar to rubber when the temperature is increased beyond the glass transition temperature $T_g$), the most preferable being the acrylic acid esters chosen from the class comprising polymethylacrylate, polyethylacrylate, polybutylacrylate, polyethoxyethylacrylate, polyhexylacrylate, polyethylhexylacrylate, polybutylmethacrylate and polyethoxyethylmethylmethacrylate.

Said auxiliary colloidal silver layer usually has a thicknes of 1 to 10μ, preferably 2 to 6μ, and is spread over a support with a substrate normally used in the photographic art, preferably cellulose triacetate. Said layer contains gelatin in a quantity of 1.5 to 6 g/m$^2$, preferably 2 to 4 g/m$^2$, and the oil droplets dispersed therein being present in the proportion of at least 0.50 with respect to the gelatin (smaller quantities of oil being less useful for the purposes of the present invention because they do not always ensure total absence of breakage of the material), the vinyl addition polymer latex being present in the proportion of at least 0.10 with respect to the gelatin (smaller quantities of the polymer being less useful for the purposes of the present invention because they would lead to lower adhesion between the gelatin layers and the support). It has also been found that there are no critical upper limits to the quantities of oil and polymer used in the auxiliary layer for the purposes of the present invention, and total absence of layer breakages, together with improved adhesion between the gelatin layers and the support are always obtained if the oil and polymer are added in quantities greater than the minimum determined value. However, in practice, excessive proportions of oil and polymer with respect to the gelatin can lead to physical drawbacks (surface oozing or opacity of the layer), and in particular of a sensitometric nature (fall in the maximum density, loss of sensitivity, crystallization of the coupling agents). Consequently, the weight ratio of the oil with respect to the gelatin of the auxiliary layer preferably does not exceed 1.2, more preferably 1.0, and the weight ratio of the polymer with respect to the gelatin preferably does not exceed 1, and more preferably 0.3.

Although the invention is particularly suitable for conventional color photographic elements of negative reversible type designed for exposure in a camera, they can also be useful for other color photographic elements characterized by a different arrangement of sensitive layers, such as positive elements for the cinema, printing, duplicating, etc.

The element can also contain chemical sensitizers, spectral sensitizers and desensitizers, optical bleaches, anti-fog and stabilizing agents, coupling agents, screening and anti-fog dyes, hydrophilic colloids and gelatin substituents, hardeners, spreading aids, plasticizers, antistatic agents and matting agents as known to the expert of the art. It can be prepared by known spreading methods on known supports (even though the invention appears most particularly useful for photographic elements having triacetate as the support), and treated in various treatments as described in Research Disclosure, December 1978, 17643, which is incorporated herein by reference.

The examples given hereinafter in order to better illustrate the invention include certain experimental data obtained from processes and measurements which are of normal use in the art. In particular, with regard to fragility, 30 cm long samples of 35 mm width strips of the photographic elements described hereinafter by way of example were conditioned for 12–24 hours at a temperature of 20°–22° C. and a relative humidity of 20%, and subjected to the fragility measurement test (WBT) described in the American National Standard ANSI PHI. 31-1973. The results of the test are expressed in terms of the diameter of curvature (in inches) at which the samples broke (the greater the breakage curvature diameter, the greater the fragility). With regard to fragility, other samples of the same dimensions as given heretofore were subjected to a subjective evaluation of the fragility consisting of pressing the sample, conditioned as heretofore described, bent between the index finger and the thumb of the hand, in different parts of it and evaluating the percentage of total breakages (a test which reproduces that which happens in practice when loading a camera).

Dry adhesion was measured by subjectively evaluating the extent of separation of the emulsion layers from the auxiliary layer and/or of the auxiliary layer from the support which occurs during carrying out the WBT test. Eight points were awarded for those cases in which there is no separation between the layers themselves or between the layers and the support, and two points were awarded for those cases in which there is complete separation of the film from the support and/or from the auxiliary layer.

EXAMPLE 1

A multi-layer color photographic film (A) was prepared by spreading the following layers over a substrated cellulose triacetate support in the order indicated:

First layer:

An auxiliary layer of 4.05 g/m² of gelatin containing 0.2 g/m² of black colloidal silver.

Second layer:

A layer of bromo-iodide emulsion in gelatin of low sensitivity towards red (formed from a gelatin emulsion of silver bromo-iodide containing 7.2 mol % of silver iodide), having a dry thickness of 3.7μ and containing 1.25 g/m² of silver, and a cyanonaphtholic coupling agent and a colored cyanonaphtholic coupling agent dispersed in a mixture of tricresylphosphate and dibutylphthalate.

Third layer:

A layer of silver bromo-iodide emulsion, of high sensitivity towards red (formed from a gelatin emulsion of silver bromo-iodide containing 7.2 mol % of silver iodide), having a dry thickness of 1.5μ and containing 0.7 g/m² of silver and a cyanophenolic coupling agent and the same colored cyanonaphtholic coupling agent as the second layer dispersed in tricresylphosphate.

Fourth layer:

A layer of 1.3 g/m² of gelatin containing 2,5-diisooctylhydroquinone dispersed in triphenylphosphate and dibutylphthalate and having a dry thickness of 1.3μ.

Fifth layer:

A layer of silver bromo-iodide emulsion in gelatin of low sensitivity towards green (formed from a gelatin emulsion of silver bromo-iodide containing 7.2 mol % of silver iodide), having a dry thickness of 4.0μ and containing 2.0 g/m² of silver and a pyrazolonic magenta coupling agent, a colored pyrazolonic coupling agent and a DIR magenta coupling agent dispersed in tricresylphosphate.

Sixth layer:

A layer of silver bromo-iodide emulsion in gelatin of high sensitivity towards green (formed from a gelatin emulsion of silver bromo-iodide containing 7.2 mol % of silver iodide), having a thickness of 1.9μ and the same magenta coupling agents, colored coupling agent and DIR coupling agent as the fifth layer dispersed in tricresylphosphate.

Seventh layer:

A layer of 1.04 g/m² of gelatin containing yellow colloidal silver and 2,5-dioctylhydroquinone dispersed in tricresylphosphate, having a dry thickness of 1.2μ.

Eighth layer:

A layer of silver bromo-iodide emulsion in gelatin sensitive to blue (40% of which is formed from a silver bromo-iodide emulsion of low sensitivity containing 7.2 mol % of silver iodide, and 60% of which is formed from a silver bromo-iodide emulsion of still lower sensitivity containing 2 mol % of silver iodide) having a dry thickness of 4.0μ and containing 0.91 g/m² of silver and a 4-equivalent yellow coupling agent dispersed together with a 2-equivalent yellow coupling agent in a mixture of tricresylphosphate and diethyllauramide.

Ninth layer:

A layer of silver bromo-iodide emulsion in gelatin of high sensitivity towards blue (formed from a gelatin emulsion of silver bromo-iodide containing 7.2 mol % of silver iodide) having a dry thickness of 1.9μ, and containing 0.56 g/m² of silver and the 2-equivalent yellow coupling agent and 4-equivalent yellow coupling agent of the eighth layer dispersed in tricresylphosphate and diethyllauramide.

Tenth layer:

A layer of 1.46 g/m² of gelatin having a dry thickness of 1.2μ and containing the ultraviolet absorber 2-(2'-hydroxy-3',5'-ditert-amylphenyl)-benzotriazole dispersed in dibutylformamide.

Eleventh layer:

A layer of 0.77 g/m² of gelatin having a dry thickness of 1.0μ containing polymethylmethacrylate particles of an average size of 2–4μ.

A second multi-layer color photographic film (B) was prepared in a like manner to film (A), but with the difference that the first layer spread over the substrated support had the following composition:

An anti-halo layer of 4.20 g/m² of gelatin containing 0.2 g/m² of black colloidal silver and 6.2 g/m² of dispersion 1, described hereinafter, equal to 0.635 g/m² of oil.

A third film (C) was prepared in a like manner to film (B), but with an anti-halo layer spread over the substrated support consisting of 4.35 g/m² of gelatin containing 0.2 g/m² of black colloidal silver and 12.4 g/m² of dispersion 1, equal to 1.27 g/m² of oil.

A fourth film (D) was prepared in a like manner to film (B), but with an anti-halo layer spread over the support consisting of 2.10 g/m² of gelatin containing 0.20 g/m² of black colloidal silver, 6.2 g/m² of dispersion 1, equal to 0.635 g/m² of oil, and 2.11 g/m² of polyethylacrylate in the form of particles of average size 0.05 dispersed in water.

A fifth and last film (E) was prepared in a like manner to film (B), but with an anti-halo layer spread over the substrated support consisting of 2.24 g/m² of gelatin containing 0.20 g/m² of black colloidal silver, 12.4 g/m² of dispersion 1, equal to 1.27 g/m² of oil, and 2.11 g/m² of the same polyethylacrylate as film (D).

Preparation of dispersion 1:

Six g of 2,5-diisooctylhydroquinone were dissolved in 5.25 g of dibutylphthalate, 5 g of triphenylphosphate and 4.6 g of ethylacetate at 45° C. The resultant solution was added under stirring to an aqueous solution of 2.4 g of gelatin at 45° C. containing 0.5 g of diisooctylsulphosuccinate, the mixture then being dispersed by means of a rotating homogenizer to give 100 g of dispersion 1.

The fragility and adhesion characteristics were then measured as described heretofore. The results of the various tests are given in Table 1, from which it can clearly be seen that these characteristics are both good only for film (E) prepared according to the present invention.

TABLE 1

| Film | Oil/ gel. | PEA/ gel. | Gel. g/m² | WBT | Fragility % Breakage | Dry Adhesion |
|---|---|---|---|---|---|---|
| A | — | — | 4.05 | 0.25 | 100 | 8 |
| B | 0.15 | — | 4.20 | 0.24 | 100 | 8 |
| C | 0.29 | — | 4.35 | 0.11 | 98 | 6 |
| D | 0.30 | 1.00 | 2.10 | 0.17 | 98 | 8 |

TABLE 1-continued

| Film | Oil/ gel. | PEA/ gel. | Gel. g/m² | WBT | Fragility % Breakage | Dry Adhesion |
|---|---|---|---|---|---|---|
| E | 0.57 | 0.94 | 2.24 | 0.08 | 0 | 8 |

EXAMPLE 2

A multi-layer color photographic film (A) was prepared in a like manner to film (A) of Example 1.

A second film (B) was prepared with the same sequence and composition of layers as the film (A), with the only difference that the first layer was of the following composition: an anti-halo layer of 3.30 g/m² of gelatin containing 0.20 g/m² of black colloidal silver and 12.4 g/m² of dispersion 1, equal to 1.27 g/m² of oil, and 1.05 g/m² of the same polyethylacrylate as Example 1.

A third film (C) was prepared in a like manner to film (B), but with an anti-halo layer spread over the support consisting of 2.37 g/m² of gelatin containing 0.20 g/m² of black colloidal silver, 12.4 g/m² of the dispersion 1 of Example 1, equal to 1.27 g/m² of oil, and 2.11 g/m² of the same polyethylacrylate of Example 1.

A fourth film (D) was prepared in a like manner to film (B), but having an anti-halo layer spread over the support consisting of 2.54 g/m² of gelatin containing 0.20 g/m² of black colloidal silver, 24.8 g/m² of the dispersion of Example 1, equal to 2.54 g/m² of oil, and 2.11 g/m² of the same polyethylacrylate as Example 1.

A fifth film (E) was prepared in a like manner to film (B), but having an anti-halo layer spread over the support consisting of 1.95 g/m² of gelatin containing 0.20 g/m² of black colloidal silver and 2.11 g/m² of the same polyethylacrylate as Example 1.

Samples of the film prepared in this manner were subjected to the fragility and adhesion tests as described heretofore. The results are given in Table 2, from which it is clear that good fragility and adhesion characteristics are obtained only for the films (C) and (D), prepared according to the present invention.

TABLE 2

| Film | Oil/ gel. | PEA/ gel. | Gel. g/m² | WBT | Fragility % Breakage | Dry Adhesion |
|---|---|---|---|---|---|---|
| A | — | — | 4.05 | 0.24 | 100 | 8 |
| B | 0.38 | 0.32 | 3.30 | 0.19 | 100 | 8 |
| C | 0.54 | 0.89 | 2.37 | 0.04 | 0 | 8 |
| D | 1.00 | 0.83 | 2.54 | 0.04 | 0 | 8 |
| E | — | 1.08 | 1.95 | 0.19 | 100 | 8 |

EXAMPLE 3

A multi-layer color photographic film (A) was prepared in a like manner to film (A) of Example 1.

A further eight films (B to I) were prepared in a like manner to film (A), the only difference being that the first anti-halo layers of each film spread over the substrated support contained different quantities of dispersions 1 to 5, which were prepared as dispersion 1 of Example 1, and containing per 100 g of dispersion the compositions given in Table 3 below, together with variable quantities of the same polyethylacrylate as Example 1.

TABLE 3

| Dispersions | | 1 | 2 | 3 | 4 | 5 |
|---|---|---|---|---|---|---|
| 2,5-diisooctylhydroquinone | g | 2.3 | 2.3 | 0.7 | — | — |
| dibutylphthalate | g | 10.5 | 10.5 | 10.5 | 10.5 | 10.5 |
| ethyl acetate | g | 9 | 9 | 9 | 4.5 | 4.5 |

TABLE 3-continued

| Dispersions | | 1 | 2 | 3 | 4 | 5 |
|---|---|---|---|---|---|---|
| dry gelatin | g | 2.4 | 2.4 | 3.2 | 3.2 | 3.2 |
| sodium diiso-octylsulphosuccinate | g | 0.36 | — | — | — | 0.36 |
| lauryl + myristyl-sodium sulphate | g | — | 0.25 | 0.25 | 0.25 | — |

Samples of the films prepared in this manner were subjected to the fragility and dry adhesion tests as described heretofore. The results of the various tests are given in Table 4, together with the composition of the first anti-halo layers of each film.

TABLE 4

| Film | Disper-sion | Oil/ gel. | PEA/ gel. | Gel. g/m² | WBT | Fragility % Breakage | Dry Adhesion |
|---|---|---|---|---|---|---|---|
| A | — | — | — | 4.05 | 0.24 | 100 | 8 |
| B | 1 | 0.75 | 0.11 | 2.21 | 0.04 | 0 | 8 |
| C | 2 | 0.75 | — | 2.21 | 0.04 | 0 | 4 |
| D | 3 | 0.86 | — | 2.21 | 0.04 | 3 | 5 |
| E | 4 | 0.93 | — | 2.21 | 0.04 | 3 | 3 |
| F | 5 | 0.93 | — | 2.21 | 0.04 | 0 | 2 |
| G | 1 | 0.75 | 0.07 | 2.21 | 0.05 | 33 | 7/8 |
| H | 1 | 0.75 | 0.03 | 2.21 | 0.05 | 10 | 4 |
| I | 2 | 0.75 | 0.03 | 2.21 | 0.05 | 10 | 5 |

I claim:

1. A silver halide photographic element comprising a support on which there is spread a plurality of silver halide photosensitive layers containing color photographic couplers, these layers being associated with auxiliary gelatin layers, and said element further comprising, spread over said support under said plurality of photosensitive layers, a layer of gelatin in which there is dispersed an effective amount of droplets of a water-immiscible high boiling organic solvent which reduces adhesion between the support and the photosensitive layers, and an effective amount of a vinyl addition polymer latex.

2. A photographic element as claimed in claim 1, wherein said organic solvent has a boiling point exceeding 200° C. and a water solubility of less than 0.5 g per liter at 25° C.

3. A photographic element as claimed in claim 2, wherein said organic solvent is chosen from the class consisting of dibutylphthalate, tricresylphosphate, triphenylphosphate, di-(2-ethylhexyl)-phthalate, di-n-octylphthalate, tri-(2-ethylhexyl)-phosphate, acetyltributylcitrate, di-(N-hexyl-)-adipate, di-(2-ethylhexyl)-adipate, dimethylsebacate, triethylenelycol-di-2-ethylhexoate, ethylphthalylethylglycolate, quinitol-bis-(2-ethylhexoate) and 1,4-cyclohexyl-dimethylene-bis-(2-ethylhexoate).

4. A photographic element as claimed in claim 1, wherein said vinyl addition polymer has a glass transition temperature of less than 25° C.

5. A photographic element as claimed in claim 3, wherein said vinyl addition polymer has a glass transition temperature of less than 25° C.

6. A photographic element as claimed in claim 1, wherein said vinyl addition polymers are chosen from the class consisting of polymethylacrylate, polyethylacrylate, polybutylacrylate, polyethoxyethylacrylate, polyhexylacrylate, polyethylhexylacrylate, polybutylmethacrylate and polyethoxyethylmethacrylate.

7. A photographic element as claimed in claim 3, wherein said vinyl addition polymers are chosen from the class consisting of polymethylacrylate, polyethylacrylate, polybutylacrylate, polyethoxyethylacrylate, polyhexylacrylate, polyethylhexylacrylate, polybutylmethacrylate and polyethoxyethylmethacrylate.

8. A photographic element as claimed in claim 1, wherein said organic solvent and/or vinyl addition polymer are in the proportions of at least 50% and at least 10% by weight respectively, with respect to the gelatin of said non-sensitive auxiliary gelatin layer.

9. A photographic element as claimed in claim 7, wherein said organic solvent and/or vinyl addition polymer are in the proportions of at least 50% and at least 10% by weight respectively, with respect to the gelatin of said non-sensitive auxiliary gelatin layer.

10. A photographic element as claimed in claims 1, 3, or 8, wherein said dispersed droplets have a size of between 0.1 and 1 micron.

11. A photographic element as claimed in claims 1, 3, or 8, wherein said latex particles have a size of between 0.03 and 0.4 microns.

12. A photographic element as claimed in claim 1, wherein said non-sensitive auxiliary gelatin layer is an anti-halo layer.

13. A photographic element as claimed in claims 1, 3, or 8, wherein said non-sensitive auxiliary gelatin layer has a thickness of between about 1 and about 10 microns.

14. A silver halide photographic element comprising a subbed support on which there is spread a plurality of silver halide photosensitive layers containing color photographic couplers, these layers being associated with auxiliary gelatin layers, and said element further comprising, spread over said subbed support under said plurality of photosensitive layers, a layer of gelatin in which there is dispersed an effective amount of droplets of a water-immiscible high boiling organic solvent, and an effective amount of vinyl addition polymer latex.

* * * * *